US009736909B2

(12) United States Patent
Rawal et al.

(10) Patent No.: US 9,736,909 B2
(45) Date of Patent: Aug. 15, 2017

(54) UNIVERSAL DIMMER WITH AUTO LOAD DETECTION AND RELATED METHODS OF OPERATION

(71) Applicant: Eaton Corporation, Cleveland, OH (US)

(72) Inventors: Nitin Rawal, Pune (IN); Swapnil Suresh Sabde, Pune (IN); Gayatri Vinod Pandit, Pune (IN); Navneet Ramkrushnaji Dhote, Pune (IN); Vinay Mahantgauda Patil, Pune (IN); Oscar L Neundorfer, Senoia, GA (US); Pramod Kumar, Peachtree City, GA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 14/797,406

(22) Filed: Jul. 13, 2015

(65) Prior Publication Data

US 2017/0019975 A1 Jan. 19, 2017

(51) Int. Cl.
*H05B 37/02* (2006.01)
*H05B 33/08* (2006.01)

(52) U.S. Cl.
CPC ..... *H05B 37/0227* (2013.01); *H05B 33/08* (2013.01); *H05B 37/02* (2013.01)

(58) Field of Classification Search
CPC ..... H05B 37/02; H05B 39/08
USPC ..... 315/291, 307, 316
See application file for complete search history.

(56) References Cited

U.S. PATENT DOCUMENTS

| | | | | |
|---|---|---|---|---|
| 8,547,035 | B2 * | 10/2013 | Kumar | H05B 39/044 315/246 |
| 2013/0030589 | A1 * | 1/2013 | Pessina | H05B 37/0272 700/295 |
| 2014/0125234 | A1 * | 5/2014 | Sadwick | H05B 37/0218 315/158 |
| 2014/0176016 | A1 * | 6/2014 | Li | H05B 33/0803 315/307 |
| 2014/0312776 | A1 * | 10/2014 | Park | H05B 33/0845 315/129 |

* cited by examiner

*Primary Examiner* — Tung X Le
(74) *Attorney, Agent, or Firm* — Myers Bigel, P.A.

(57) ABSTRACT

Universal dimmers are provided including a mode selection circuit configured to receive an input related to a load associated with the universal dimmer. The mode selection circuit is configured to select between more than two modes of operation of the universal dimmer. Related methods of operation are also provided.

11 Claims, 8 Drawing Sheets

UNIVERSAL DIMMER WITH AUTO LOAD DETECTION AND RELATED METHODS OF OPERATION

FIELD

The inventive concept generally relates to illumination and, more particularly, to regulating illumination output from a light.

BACKGROUND

Dimmers are generally used to regulate the illumination level output from a light by controlling the voltage, current and/or power available to the light through various different regulation/dimming schemes. In practice, it may be necessary to select an appropriate dimmer for the corresponding load. Thus, different types of dimmers are available for the various loads, each load having a corresponding dimmer type. Thus, in practice, an incorrect dimmer may be mistakenly connected to a given load during installation. Improved devices for regulating illumination may be desired.

SUMMARY

Some embodiments of the inventive concept provide universal dimmers including a mode selection circuit configured to receive an input related to a load associated with the universal dimmer. The mode selection circuit is configured to select between more than two modes of operation of the universal dimmer.

In further embodiments, the input related to a load associated with the universal dimmer may include one of a manual selection of one of the more than two modes of operation by a user of the universal dimmer and zero crossing information related to a voltage and/or current of the load.

In still further embodiments, when the input is zero crossing information related to a voltage and/or current of the load, the mode selection circuit may operate in an automatic detection mode. In this mode, the mode selection circuit maybe configured to automatically detect the load and select the mode of the universal dimmer based on the detected load and the zero crossing information.

In some embodiments, the mode selection circuit may be configured to monitor the zero crossing information for multiple cycles before automatically selecting a mode for the universal dimmer from the two or more modes. In certain embodiments, automatic mode detection may be completed within about 250 ms.

In further embodiments, the more than two modes may include a forward mode, a reverse mode and an automatic mode.

In still further embodiments, a controller associated with the mode selection circuit may be provided. The controller may be configured to receive the input from the mode selection circuit. The input includes one or more of zero crossing information related to a supply voltage; zero crossing information related to a supply current; and input from a switch associated with the two or more modes of the universal dimmer.

In some embodiments, the universal dimmer may include a mode selection switch coupled to the mode selection circuit configured to all manual selection of the two or more modes of the universal dimmer.

In further embodiments, the mode selection switch may be placed on a housing of the universal dimmer to comply with existing form factors of universal dimmers.

Still further embodiments of the present inventive concept provide methods of operating a universal dimmer comprising receiving input at a mode selection circuit of the universal dimmer, the input related to a load associated with the universal dimmer; and selecting, at the mode selection circuit, between more than two modes of operation of the universal dimmer.

In some embodiments, the input related to a load associated with the universal dimmer may include one of a manual selection of one of the more than two modes of operation by a user of the universal dimmer and zero crossing information related to a voltage and/or current of the load.

In further embodiments, the method may further include operating the mode selection circuit in an automatic detection mode when the input to the mode selection circuit is zero crossing information related to a voltage and/or current of the load; automatically detecting the load associated with the universal dimmer; and automatically selecting the mode of the universal dimmer based on the detected load and the zero crossing information.

In still further embodiments, automatically detecting may include monitoring the zero crossing information for multiple cycles before automatically selecting a mode for the universal dimmer from the two or more modes. Automatically detecting may be completed within about 250 ms.

In some embodiments, the more than two modes may include a forward mode, a reverse mode and an automatic mode.

In further embodiments, receiving input from the mode selection circuit may include one or more of receiving zero crossing information related to a supply voltage; receiving zero crossing information related to a supply current; and receiving input from a switch associated with the two or more modes of the universal dimmer.

DETAILED DESCRIPTION OF EMBODIMENTS

Figure 1:
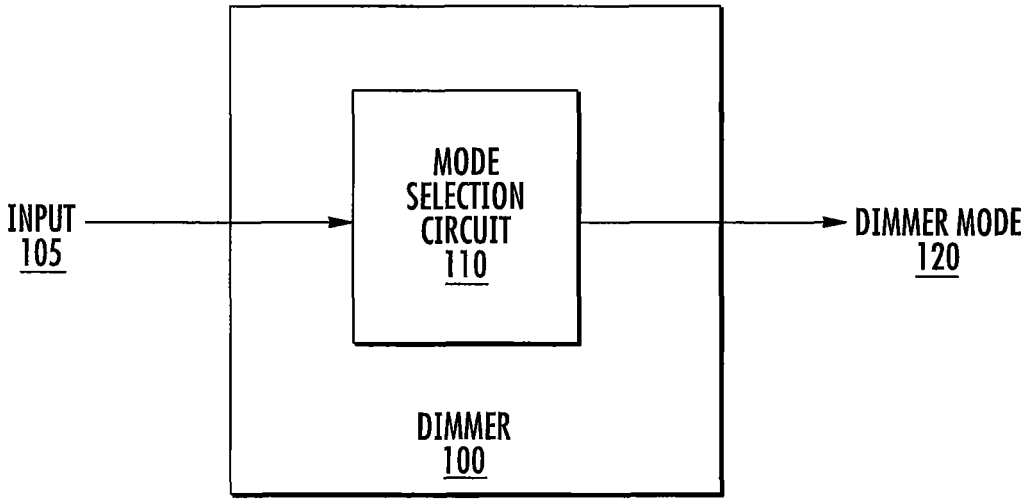
FIG. 1 is a block diagram illustrating a basic universal dimmer according to some embodiments of the present inventive concept.

The inventive concept now will be described more fully hereinafter with reference to the accompanying drawings, in which illustrative embodiments of the inventive concept are shown. In the drawings, the relative sizes of regions or features may be exaggerated for clarity. This inventive concept may, however, be embodied in many different forms and should not be construed as limited to the embodiments set forth herein; rather, these embodiments are provided so that this disclosure will be thorough and complete, and will fully convey the scope of the inventive concept to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, lithe device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As discussed above, different types of dimmers are available that correspond to the various loads provided by an illumination device. Thus, it may be possible to connect the incorrect dimmer to a given load. Accordingly, some embodiments of the present inventive concept provide a universal dimmer that, by definition, can be used with multiple illumination loads. In some embodiments, the universal dimmer automatically determines which operating mode is suitable for the connected load. In some embodiments, this determination is made using a leading edge or trailing edge. Thus, some embodiments of the present inventive concept may eliminate the need for multiple types of dimmers to accommodate different loads. Thus, an electrician or user does not have stock different dimmers to ensure having a correct dimmer during dimmer installation. Furthermore, from a manufacturing standpoint, only a single dimmer with the capability of operating in multiple modes will be needed, thus, reducing overall operational costs. Details with respect to multi-mode dimmers in accordance with embodiments of the present inventive concept will be discussed further herein with respect to FIGS. 1 through 8 herein.

Referring first to FIG. 1, a simplistic block diagram of a universal dimmer in accordance with embodiments of the present inventive concept will be discussed. As illustrated in FIG. 1, the dimmer 100 receives an input 105 which is received by a mode selection circuit 110 associated with the dimmer 100. Responsive to the input 105, the mode selection circuit 110 selects an operating mode 120 for the dimmer 100. As discussed above, in some embodiments, the input 105 may be a manual input by a user of the dimmer 100. For example, a switch may be provided associated with the dimmer 100 and the user may physically move the switch to the appropriate mode for the load attached to the dimmer 100. As used herein, "load" refers to the lighting loads on the dimmer and may be used to refer to different types of lighting loads, for example, ballast, compact florescent lamps (CFL), light emitting diode (LED) lamps, incandescent lights and the like. It will be understood that embodiments of the present inventive concept are not limited to these examples and, thus, the load may be any load compatible with a dimmer as discussed herein.

In some embodiments of the present inventive concept, the dimmer mode 120 may be determined automatically, i.e., the user does not have to physically select the mode of operation for the dimmer 100 using a switch. In these embodiments, the dimmer 100 is configured to automatically detect the mode in which the dimmer should operate once the dimmer 100 is coupled to the load. For example, an input 105 provided to the mode selection circuit 110 may be the supply voltage and load current through the dimmer 100 when it is connected across the relevant load. The mode selection circuit 110 may be configured to monitor the supply voltage and load current and observe the zero crossings of the supply voltage and load current waveform. After a short observation period, the mode selection circuit 110 may select an appropriate dimmer mode 120 based on a load type, which may provide the most optimum dimming scheme for the attached load.

Figure 2:
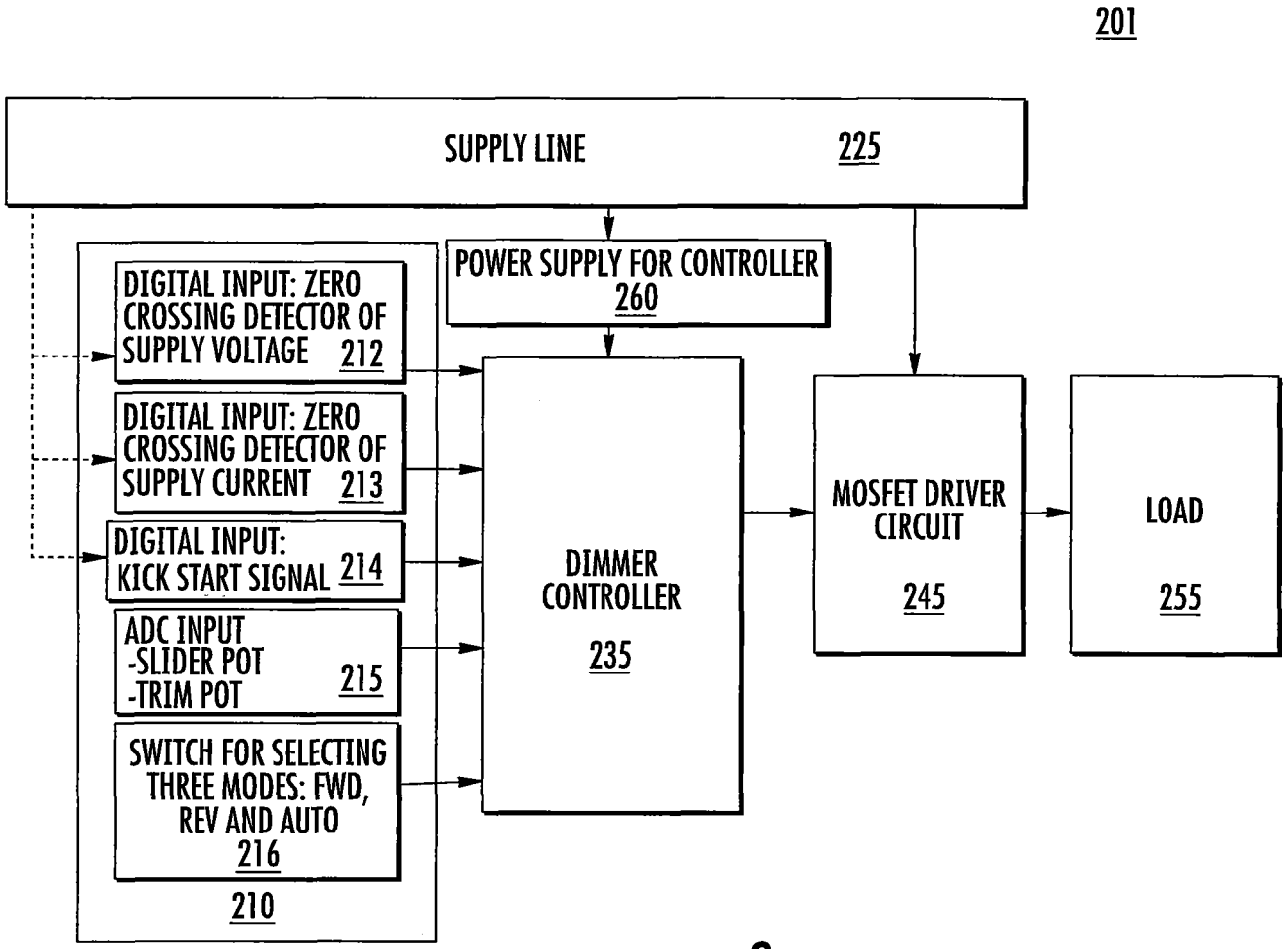
FIG. 2 is a block diagram illustrating functionality of a multi-mode dimmer in accordance with some embodiments of the present inventive concept.

Referring now to FIG. 2, a more detailed block diagram of the universal dimmer in accordance with some embodiments of the present inventive concept will be discussed. As illustrated in FIG. 2, the dimmer system 201 includes a supply line 225, a mode selection circuit 210, a dimmer controller 235, a driver 245, a load 255 and a power supply 260 for the dimmer controller 235. As discussed above, universal dimmers in accordance with embodiments discussed herein have both manual mode selection and auto load detection capabilities. The modes are configured using various combinations of hardware and software, some of which will be discussed further herein.

As illustrated in FIG. 2, the mode selection circuit 210 may include a zero crossing detector of the supply voltage 212, a zero crossing detector of the supply current 213, a kick start signal 214, an analog to digital convertor (ADC) input 215 and a switch for selecting between one of a plurality of modes 216. In some embodiment, the switch 216 may be configured to allow selection among three modes of operation, for example, forward (FWD), reverse (REV) and automatic (AUTO). However, it will be understood that embodiments of the present inventive concept are not limited to these examples. For example, less or more than three modes may be provided without departing from the scope of the present inventive concept.

As illustrated, the supply line 225 provides the digital inputs for elements 212, 213 and 214 of the mode selection circuit 210. The supply line 225 is also connected to the dimmer controller 235 through the power supply for the controller 260. The dimmer system 201 illustrated in FIG. 2 is a universal type dimmer which has standard phase control type dimming scheme. In this embodiment, a MOSFET is used as a primary switching element controlled by gate driver circuitry and a micro controller (245) capable of internally determining the mode of the dimmer, for example, "FORWARD" or "REVERSE" mode with the input/output interface.

Figure 3:
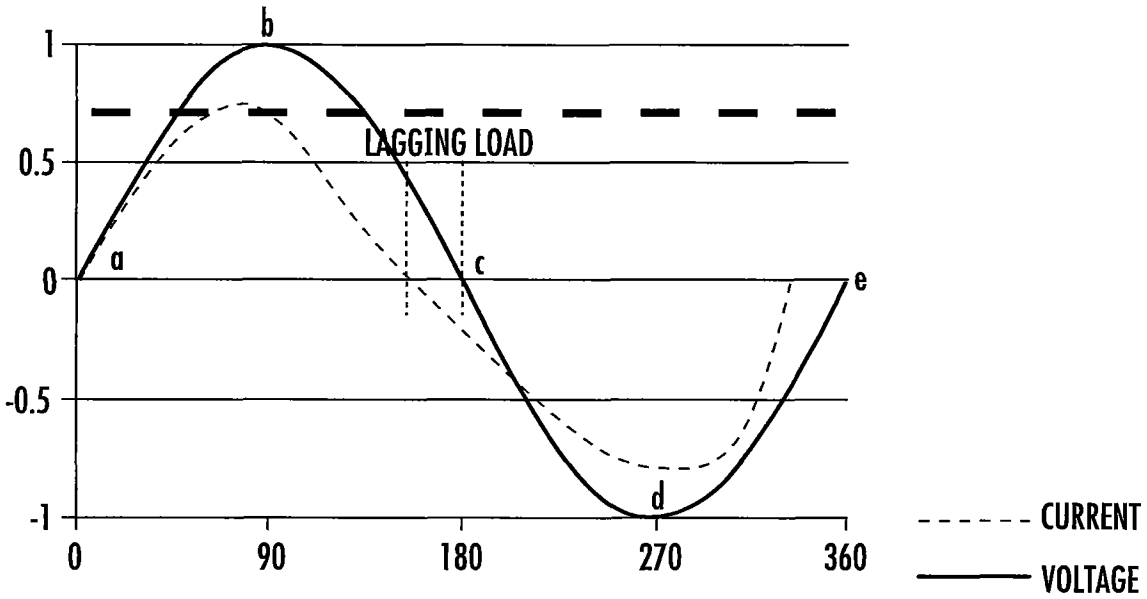
FIG. 3 is a diagram illustrating zero crossing detection in accordance with some embodiments of the present inventive concept.

In embodiments of the present inventive concept having the auto load detection scheme, the auto load detection scheme may be implemented utilizing a phase lag/lead behavior of inductive or capacitive load (associated load 255). The mode of operation of the dimmer is selected based on the determination of FWD or REV control scheme. For example, magnetic ballast is essentially an inductive load. Thus, by monitoring a supply voltage and load current through the dimmer in accordance with embodiments discussed herein when it is connected across this load 255 and observing the zero crossing of voltage and current waveform as illustrated in the graph of FIG. 3, a load type identification can be made and accordingly the best dimming scheme for that load type may be selected. In particular, positions a and e illustrate positive zero crossings, position b illustrates a positive peak crossing, position c illustrates a negative zero crossing and position d illustrates a negative peak crossing.

In particular, in accordance with some embodiments of the present inventive concept, the automatic load detection logic works on a timing comparison of zero crossing of voltage and current (FIG. 3) through, for example, a shunt. The lag/lead load (FIG. 3) characteristics may be further validated through actual testing with different type of lighting loads, for example, ballast, CFL, LED lamps, incandescent and the like.

Figure 4:
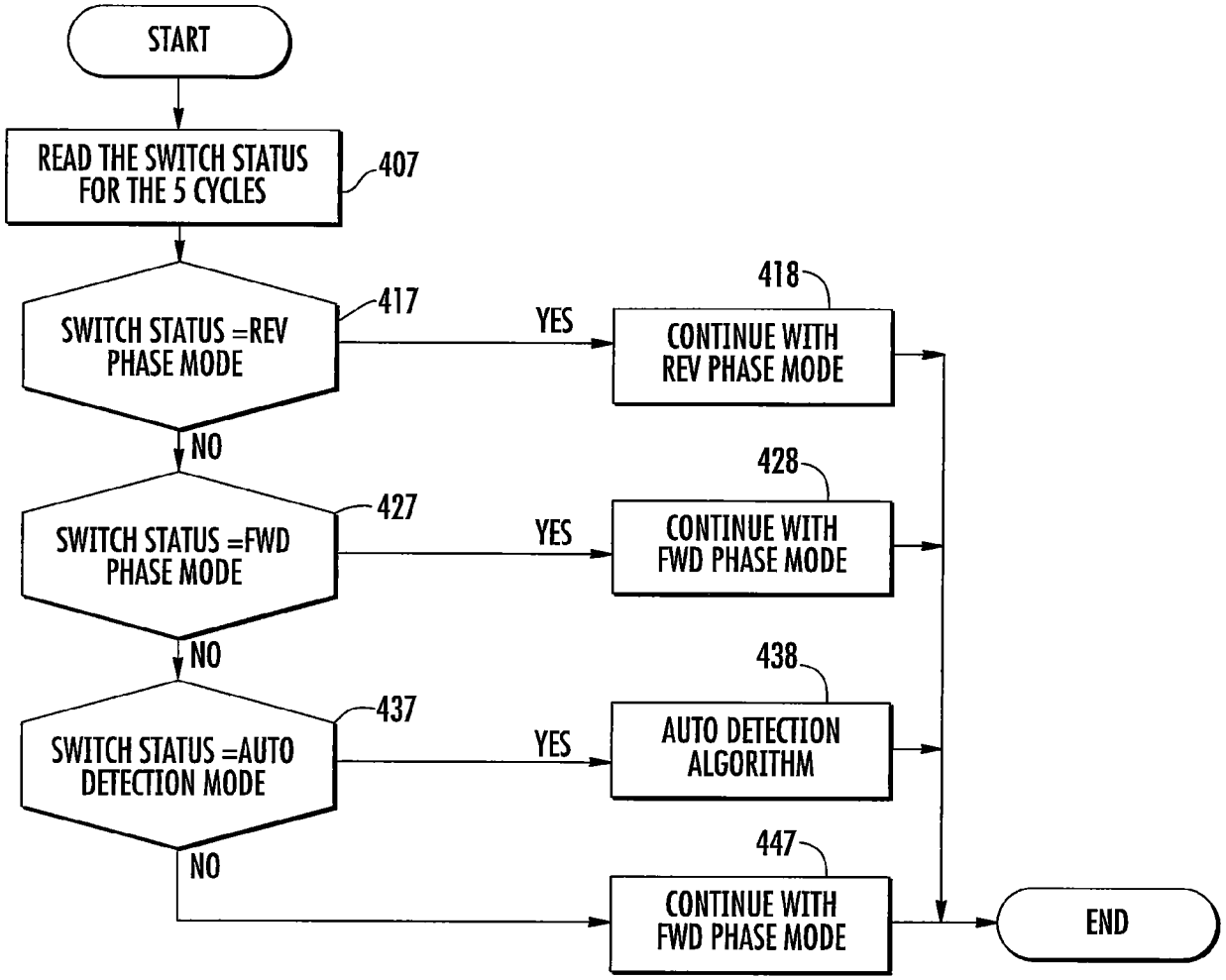
FIG. 4 is a flowchart illustrating operations in accordance with some embodiments of the present inventive concept.

As discussed above, dimmer systems in accordance with embodiments discussed herein include both hardware and software components. Referring now to FIG. 4, a flow chart illustrating operations with respect to some embodiments of the present inventive concept will be discussed. As illustrate in FIG. 4, operations begin at block 407 by reading a mode detection switch when a load is connected and turned on. A status of the mode switch may be determined (blocks 417, 427 and 437). In particular, if it is determined that the switch is in REV mode, operations continue to block 418 and operations of the dimmer are performed in REV phase mode. Similarly, if is determined that the switch is in FWD phase mode (block 427) operations continue to block 428 and continue with FWD phase operation. Thus, for embodiments operating in manual mode, the selected mode will determine the mode of operation, i.e. the selected dimming mode.

If it is determined that the switch is in AUTO mode (block 437) operations continue to block 438 and implement an auto detection algorithm (block 438), the details of which will be discussed below with respect to FIG. 5. If, on the other hand, it is determined that none of the modes (REV, FWD or AUTO) are selected, operations continue to block 447 and continue with FWD phase operation.

Figure 5:
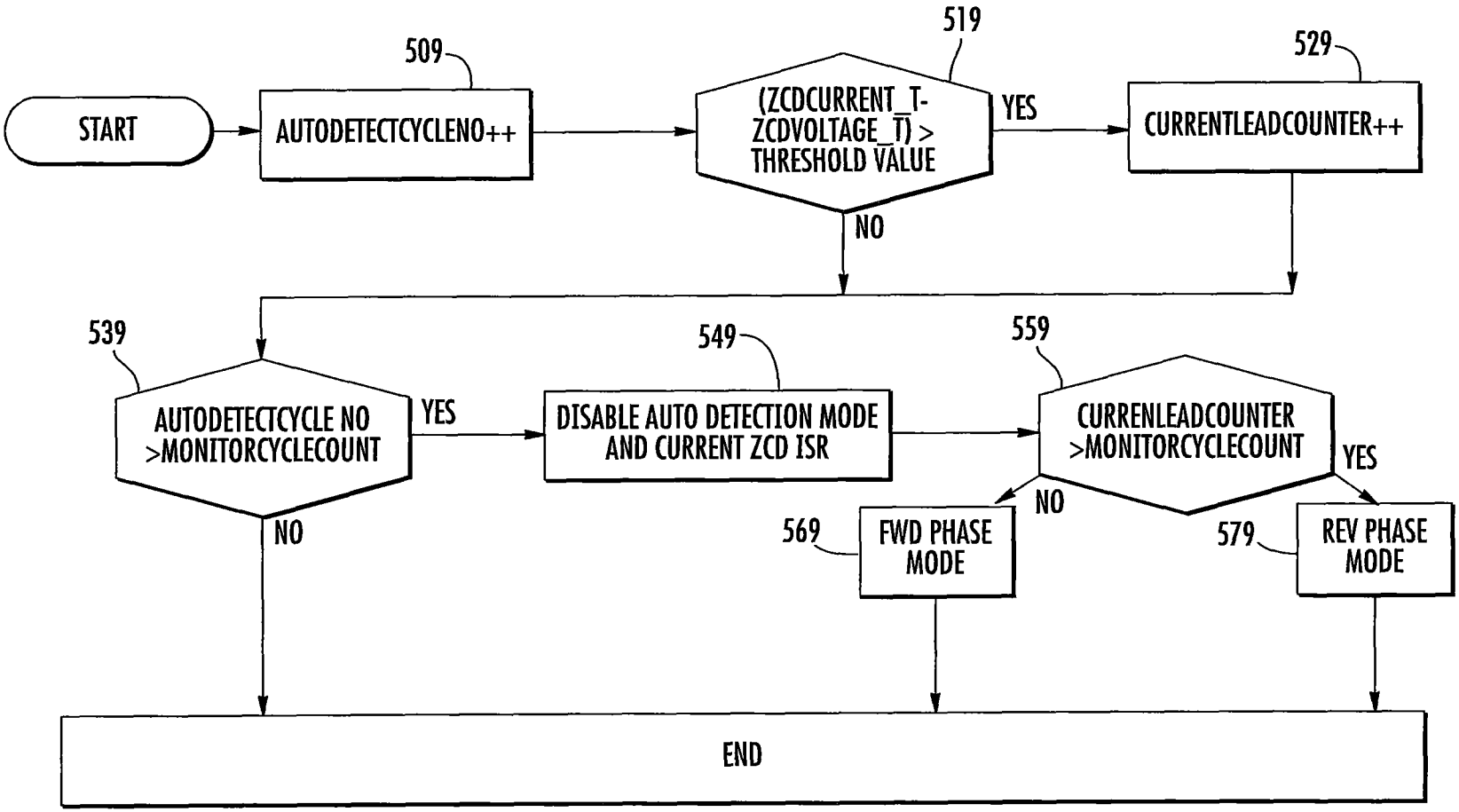
FIG. 5 is a flowchart illustrating automatic load detection in accordance with some embodiments of the present inventive concept.

Referring now to FIG. 5, a flowchart illustrating the details of the auto detection algorithm in accordance with some embodiments of the present inventive concept will be discussed. The variables referred to in the flowchart of FIG. 5 are defined as follows: AutoDetectCycleNo refers to the number of cycles of the applied supply voltage; ZCDCurrent_t refers to a variable that holds the time value at the instant of the zero crossing of current waveform; ZcdVoltage_t is a variable holds the time value at the instant of the zero crossing of Voltage waveform; threshold value is a minimum time value by which measured Load current ZCD leads the measure Supply voltage ZCD; CurrentLeadCounter is a variable counter to measure count of sine wave cycle in which current leads the Voltage; and MonitorCycleCount is a number of cycles of applied voltage that the algorithm will monitor the Lead/Lag behavior of the Current Zero Crossing detection.

As illustrated in FIG. 5, operations begin at block 509 by automatically detecting the dimmer mode based on the load connected thereto (AutoDetectCycleNo++), In particular, upon power up, a FWD (forward) phase dimming mode is used. The Lead/Lag behavior of the supply current at Negative Zero Crossing is detected (as discussed above) and dimming modes may change within a kick start time, for example, from 250-300 ms. The dimmer is switched to the REV (reverse) phase dimming mode if (ZCDCurrent_t−ZCDVoltage_t) is greater than a threshold value (block 519). As used herein, the "threshold value" may be about 300 μseconds. However, it will be understood that embodiments of the present inventive concept are not limited to this configuration. Thus, it is determined that ZCDCurrent_t−ZCDVoltage_t is greater than a threshold value, operations proceed to blocks 529 and 539. However, if it is determined that ZCDCurrent_t−ZCDVoltage_t is less than a threshold value, operations continue directly to block 539.

It is determined if the AutoDetectCycleNo is greater than the MonitorCycleCount. If AutoDetectCycleNo is not greater than the MonitorCycleCount, operations terminate (End). If, on the other hand, it is determined that AutoDetectCycleNo is greater than the MonitorCycleCount, operations proceed to block 549 and auto detection mode is disabled. It is determined if CurrentLeadCounter is greater than or equal to MonitorCycleCount (block 559). If it is determined that CurrentLeadCounter is greater than or equal to MonitorCycleCount, operations proceed to block 579 and operations are performed in REV Phase mode. If, on the other hand, it is determined that CurrentLeadCounter is not greater than or equal to MonitorCycleCount, operations proceed to block 569 and operation in FWD phase mode.

It will be understood that operations of FIGS. 4 and 5 are provided as example operations and, thus, embodiments of the present inventive concept are not limited to this configuration.

Figure 6:
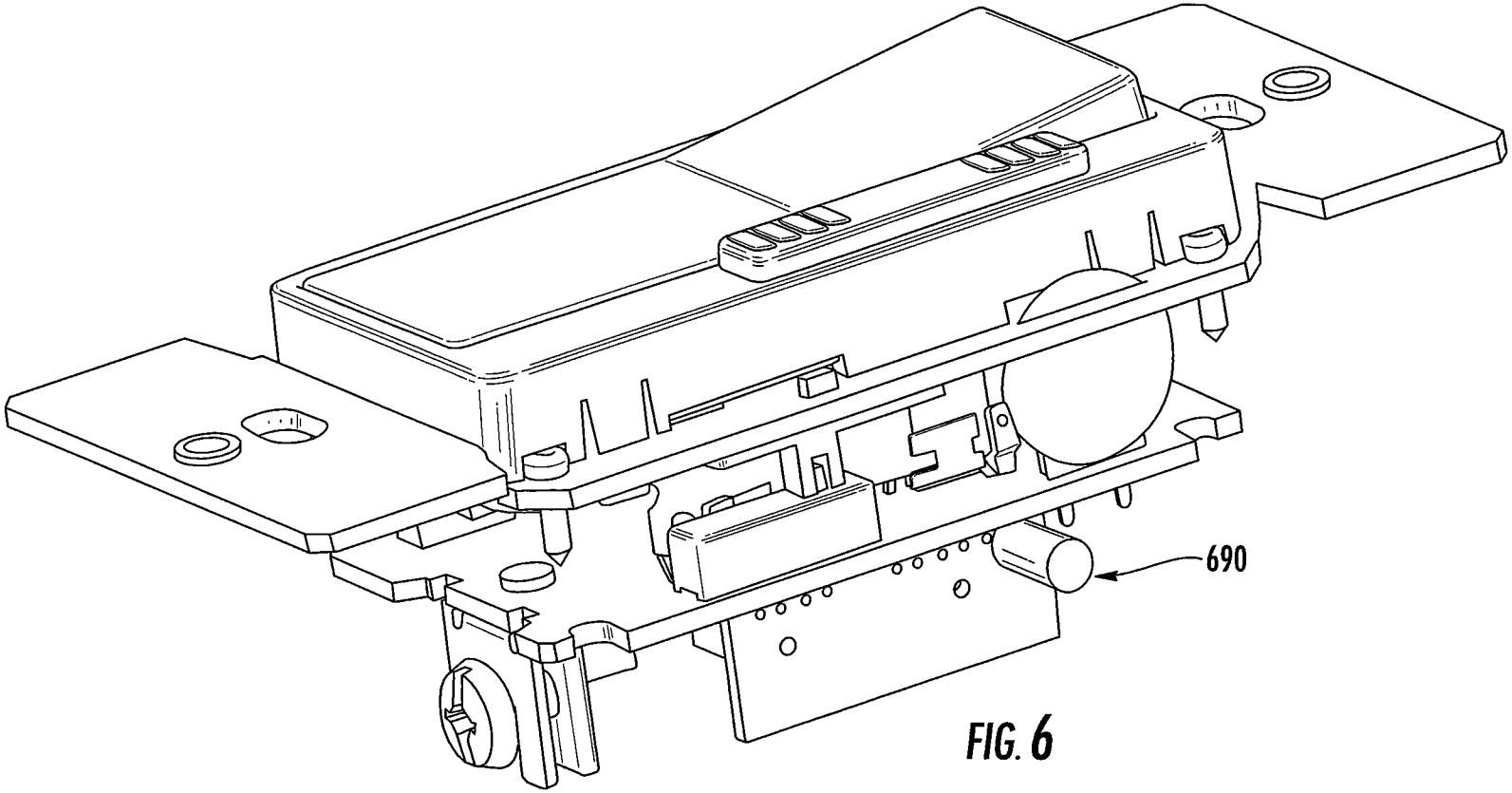
FIG. 6 is a block diagram illustrating placement of a multi-way switch in accordance with some embodiments of the present inventive concept.

Referring now to FIG. 6, a diagram illustrating an example universal dimmer including a placement of a multi-way, discussed herein as a three-way, switch will be discussed. As illustrated in FIG. 6, the multi-way switch 690 may be placed on the dimmer such that the form factor of the dimmer is not effected, for example, does not increase the size of the dimmer itself.

In particular, for a microcontroller to process or implement auto load detection and manual mode selection schemes in accordance with embodiments discussed herein, certain analog/digital (A/D) inputs, such as voltage zero crossing detection (ZCD), current ZCD and a 3-way switch including a position for each mode of the multimode device, for example, FWD, REV, and AUTO modes discussed above. To provide the additional multi-mode operation and an associated switch within the same form factor and given space of devices without these added features presents a challenge. Accordingly, some embodiments of the present inventive concept use the zero crossings to decide in which mode the dimmer should operate as discussed above.

Figure 7:
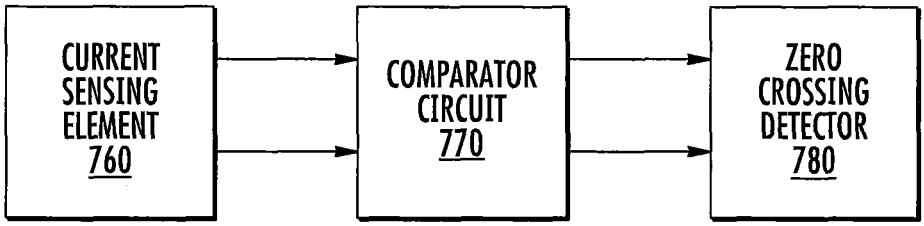
FIG. 7 is block diagram illustrating a current sensing scheme in accordance with some embodiments of the present inventive concept.

Referring now to FIG. 7, a block diagram illustrating a current sensing scheme in accordance with some embodiments of the inventive concept will be discussed. As illustrated in FIG. 7, the scheme includes a current sensing element 760, a comparator circuit 770 and a zero crossing detector 780. The current sensing element 760 may be, for example, a shunt, current sensing integrated circuit (IC), for example, ACS714LLCTR-20A from Allegro Microsystems or a current transformer (CT). However, it will be understood that embodiments of the present inventive concept are not limited to this configuration. Furthermore, the zero crossing detector 780 maybe, for example, an opto-isolator or Op-amp circuit. However, other devices may be used without departing from the scope of the present inventive concept.

Figure 8:
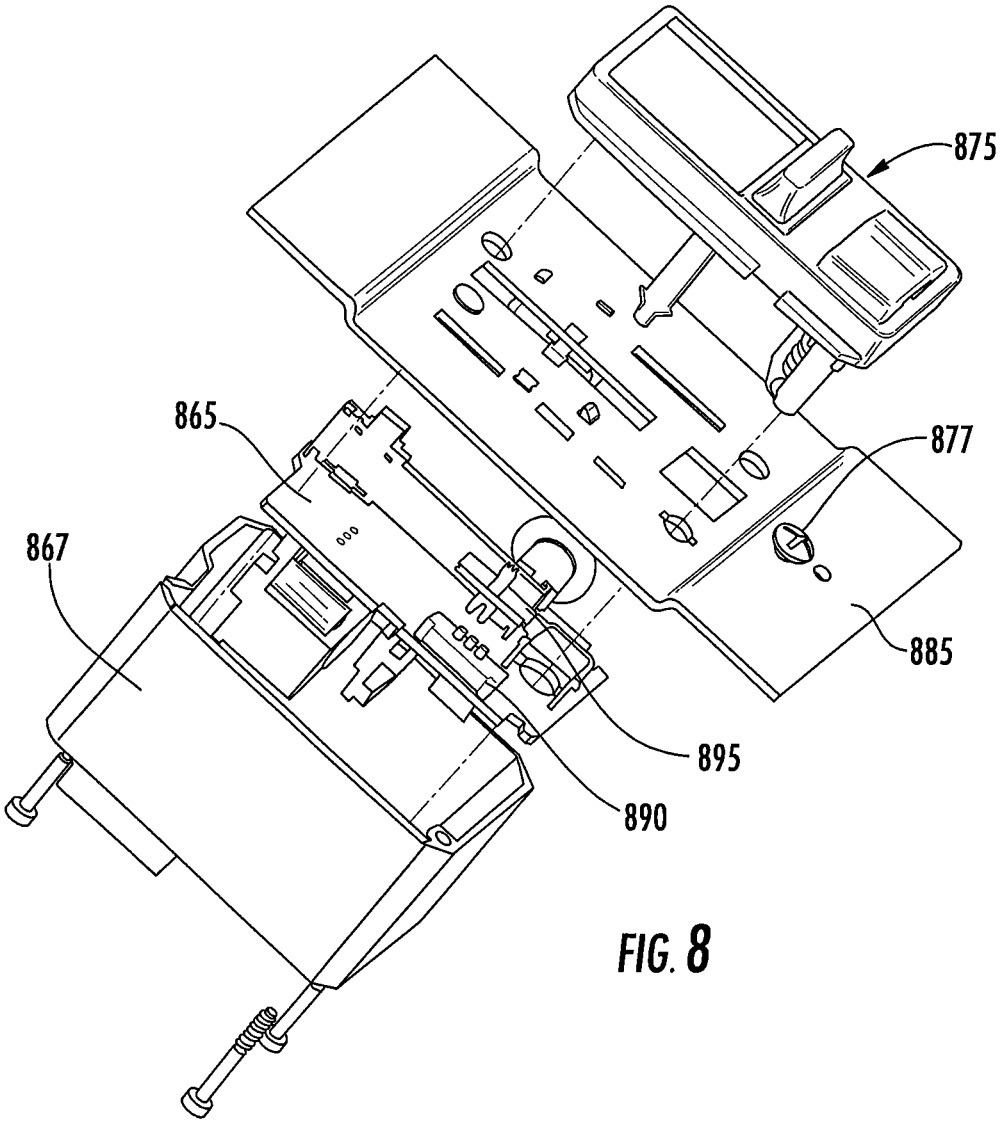
FIG. 8 is a block diagram illustrating placement of a multi-way switch in accordance with some embodiments of the present inventive concept.

Referring now to FIG. 8, a diagram illustrating placement of the switch on the dimmer in accordance with further embodiments of the inventive concept will be discussed. As illustrated in FIG. 8, the dimmer includes, a main board assembly 865, a bottom portion of the housing 867, a top portion of the housing 875, mounting screw 877 for connecting the top and bottom portions, a heat sink assembly 885, a three way switch 890 and the associated actuator 895. It will be understood that embodiments illustrated in FIGS. 6-8 are provided for example only and, therefore, embodiments of the present inventive concept are not limited to this configuration. For example, dimmers in accordance with embodiments discussed herein may include more, less or different elements than those illustrated in FIG. 8 without departing from the scope of the present inventive concept.

As discussed above, some embodiments of the present inventive concept provide a universal dimmer that, by definition, can be used with multiple illumination loads. In some embodiments, the universal dimmer automatically determines which operating mode is suitable for the connected load. Thus, some embodiments of the present inventive concept may eliminate the need for multiple types of dimmers to accommodate different loads. Thus, an electrician or user does not have stock different dimmers to ensure having a correct dimmer during dimmer installation. Furthermore, from a manufacturing standpoint, only a single dimmer with the capability of operating in multiple modes will be needed, thus, reducing overall operational costs.

In the drawings and specification, there have been disclosed exemplary embodiments of the inventive concept. Although specific terms are employed, they are used in a generic and descriptive sense only and not for purposes of limitation, the scope of the inventive concept being defined by the following claims.

That which is claimed:

1. A universal dimmer comprising a mode selection circuit configured to receive an input related to a load associated with the universal dimmer, wherein the mode selection circuit is configured to select between more than two modes of operation of the universal dimmer, wherein the input related to the load associated with the universal dimmer comprises zero crossing information related to a voltage and/or current of the load, the mode selection circuit being further configured to:

operate in an automatic detection mode such that the mode selection circuit automatically detects the load and selects the mode of the universal dimmer based on the detected load and the zero crossing information; and monitor the zero crossing information for multiple cycles before automatically selecting a mode for the universal dimmer from the two or more modes.

2. The universal dimmer of claim 1, wherein the automatic mode detection is completed within about 250 milliseconds.

3. The universal dimmer of claim 1, wherein the more than two modes comprise a forward mode, a reverse mode and an automatic mode.

4. The universal dimmer of claim 1, further comprising a controller associated with the mode selection circuit, wherein the controller is configured to receive the input from the mode selection circuit; and wherein the input comprises one or more of:

zero crossing information related to a supply voltage;

zero crossing information related to a supply current; and input from a switch associated with the two or more modes of the universal dimmer.

5. The universal dimmer of claim 1, further comprising a mode selection switch coupled to the mode selection circuit and configured to manual selection of the more than two modes of operation of the universal dimmer.

6. The universal dimmer of claim 5, wherein the mode selection switch is placed on a housing of the universal dimmer to comply with existing form factors of universal dimmers.

7. A method of operating a universal dimmer comprising:

receiving an input at a mode selection circuit of the universal dimmer, the input related to a load associated with the universal dimmer;

selecting, at the mode selection circuit, between more than two modes of operation of the universal dimmer;

operating the mode selection circuit in an automatic detection mode when the input to the mode selection circuit comprises zero crossing information related to a voltage and/or current of the load;

automatically detecting the load associated with the universal dimmer; and automatically selecting the mode of the universal dimmer based on the detected load and the zero crossing information;

wherein the load associated with the universal dimmer is a type of lighting load on the dimmer and wherein the universal dimmer is configured to support two or more types of lighting loads;

wherein the input related to the load associated with the universal dimmer comprises one of a manual selection of one of the more than two modes of operation by a user of the universal dimmer and zero crossing information related to a voltage and/or current of the load; and wherein automatically detecting further comprises monitoring the zero crossing information for multiple cycles before automatically selecting a mode for the universal dimmer from the two or more modes.

8. The method of claim 7, wherein automatically detecting is completed within about 250 milliseconds.

9. The method of claim 7, wherein the more than two modes comprise a forward mode, a reverse mode and an automatic mode.

10. The method of claim 7, wherein receiving an input at the mode selection circuit comprises one or more of:

receiving zero crossing information related to a supply voltage;

receiving zero crossing information related to a supply current; and receiving input from a switch associated with the two or more modes of the universal dimmer.

11. The method of claim 7, wherein the two or more types of lighting loads comprise a ballast, compact florescent lamps (CFL), light emitting diode (LED) lamps and incandescent lights.

* * * * *